US007475962B2

(12) United States Patent
Lai

(10) Patent No.: US 7,475,962 B2
(45) Date of Patent: Jan. 13, 2009

(54) PRINTHEAD CLEANING DEVICE FOR A LARGE PRINTER

(75) Inventor: Jin-Sheng Lai, Hsi Chih (TW)

(73) Assignee: Great Computer Corporation, Taipei Hsien (TW)

( * ) Notice: Subject to any disclaimer, the term of this patent is extended or adjusted under 35 U.S.C. 154(b) by 411 days.

(21) Appl. No.: 11/440,430

(22) Filed: May 25, 2006

(65) Prior Publication Data

US 2007/0273724 A1 Nov. 29, 2007

(51) Int. Cl.
*B41J 2/165* (2006.01)

(52) U.S. Cl. ..... 347/35; 347/29; 347/33; 347/32

(58) Field of Classification Search ..... 347/35, 347/29, 30, 32, 33
See application file for complete search history.

(56) References Cited

U.S. PATENT DOCUMENTS 5,717,446 A * 2/1998 Teumer et al. ..... 347/35

* cited by examiner

*Primary Examiner*—Shih-Wen Hsieh
(74) *Attorney, Agent, or Firm*—Troxell Law Office, PLLC

(57) ABSTRACT

A printhead cleaning device for a large printer provided at a lateral side of a printing rail of the printer, it comprises a base and a swinging platform, wherein the base has four peripheral sides forming a receiving space, the swinging platform is movably and pivotally connected to the base; the swinging platform has thereon a plurality of elongate holes, so that the residual ink on the printhead set can be collected in the receiving space of the base through the elongate holes, every two elongate holes have therebetween a scraper in the shape of a taper sectionally and made of soft material, so that when the base is pushed upwards by a pushing device to its predetermined position, the scrapers on the swinging platform can have scraping actions against the moving printhead of the printhead set.

7 Claims, 7 Drawing Sheets

PRINTHEAD CLEANING DEVICE FOR A LARGE PRINTER

BACKGROUND OF THE INVENTION

1. Field of the Invention

The present invention relates to a printhead cleaning device for a large printer, and more particularly to a printhead cleaning device that can be securely aligned with a printhead set to effectively clean without damaging the latter. The device structure is simple for assembling and is provided with drawable scrapers that are convenient for changing and cost-saving. The device is applicable to various large ink-jet printers.

2. Description of the Prior Art

In the peripheral equipments of the computer or the print industries, the printer have become already an essential fundamental equipment, which, in addition to print documents, assignments, and reports, as progressing with color ink-jet techniques, the inkjet printer can produce desirable colors by spraying color with different concentration on a same position by means of ink cartridges with different colors. Therefore, it is not a dream to produce a print with a same quality level as a photograph by using a printer.

For the printing industry, a ink-jet product is a worldwide trend, an inkjet printer can be applied for jet-printing timely a small amount of diverse products, and finished quickly, saving time and operations for making a color separating screen, that create more advantages in the competitive age.

In the use of a inkjet printer, after printing with the printhead for a period of time, the nozzle may have residual ink and dust that can affect the print quality, and after used, if the printhead leaves uncovered, the nozzle might be dried easily and hence jam the printhead. Therefore, in the design of the internal structure of current inkjet printer, a printhead service station is provided, with its main object and function to clean the printhead for maintaining the print quality and to cover the printhead after used, so as to keep the printhead moist without being dried and jammed.

However, a cleaning printhead device in a conventional printhead service station is manually operated or is connected to an external absorbing equipment to absorbing residual ink. Either mode is time-consuming and unable to clean the printhead effectively, and so is undesired.

SUMMARY OF THE INVENTION

The primary object of the present invention is to provide a printhead cleaning device for a large printer that can be securely aligned with a printhead set to effectively clean the latter without damaging.

Another object of the present invention is to provide a printhead cleaning device for a large printer that is structurally simple for assembling, and is provided with scrapers convenient for changing.

Therefore, in order to achieve the objects of the present invention, the printhead cleaning device for a large printer of the present invention is provided at a lateral side of a printing rail of a printer. It comprises a base and a swinging platform, wherein the base has four peripheral sides forming a receiving space and the swinging platform is movably and pivotally connected to the base. The swinging platform has thereon a plurality of elongate holes, so that the residual ink on the printhead set can be collected in the receiving space of the base through the elongate holes. And every two elongate holes have therebetween a scraper in the shape of a taper sectionally and made of soft material, so that when the base is pushed upwards by a pushing device to its predetermined position, the scrapers on the swinging platform can have scraping actions against the moving printhead of the printhead set.

The present invention will be apparent in its content and effects to be achieved after reading the detailed description of the preferred embodiment thereof in reference to the accompanying drawings.

DETAILED DESCRIPTION OF THE PREFERRED EMBODIMENTS

Figure 1:
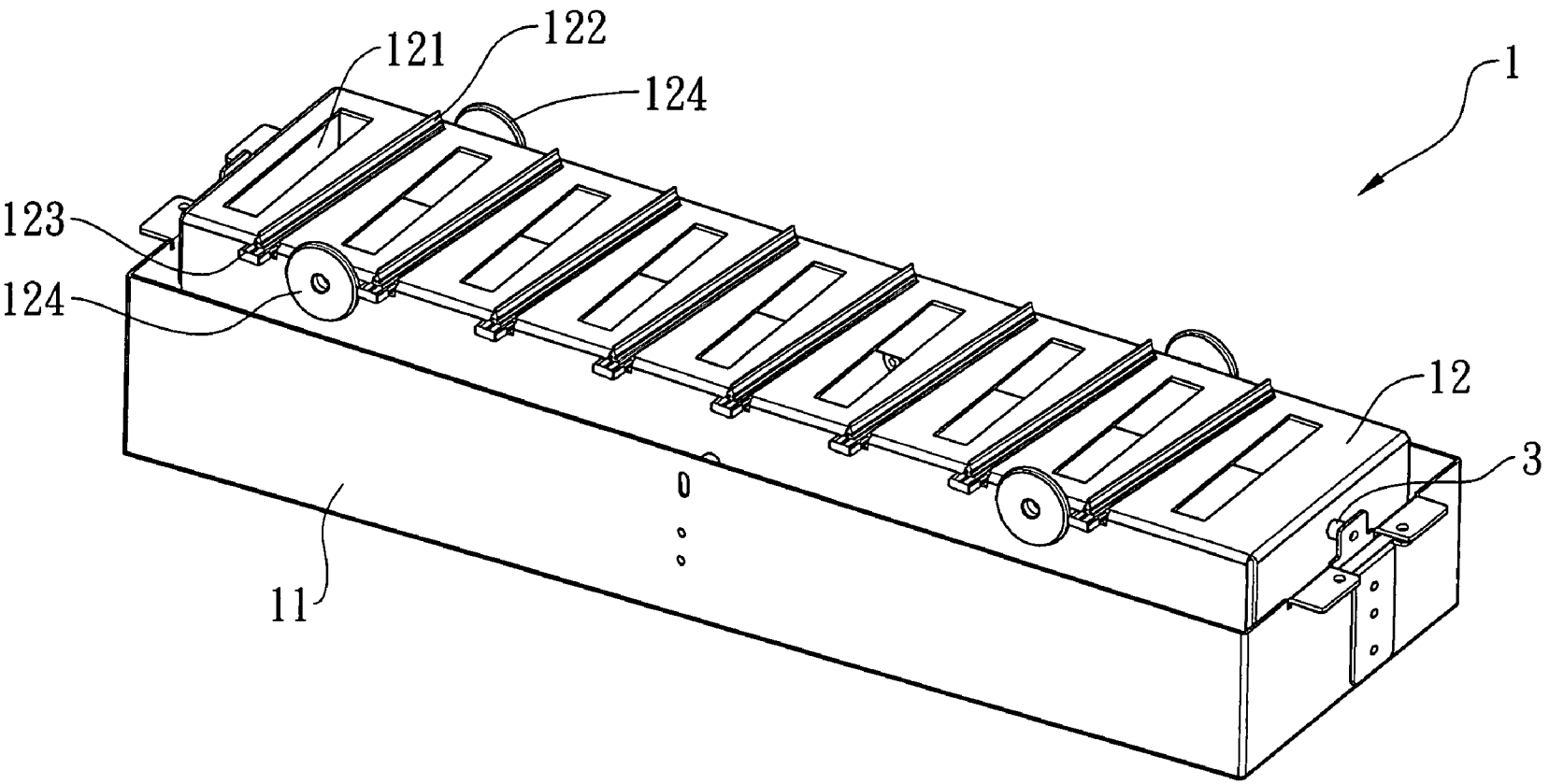
FIG. 1 is a perspective view showing the appearance of a printhead cleaning device for a large printer of an embodiment of the present invention.
Figure 2:
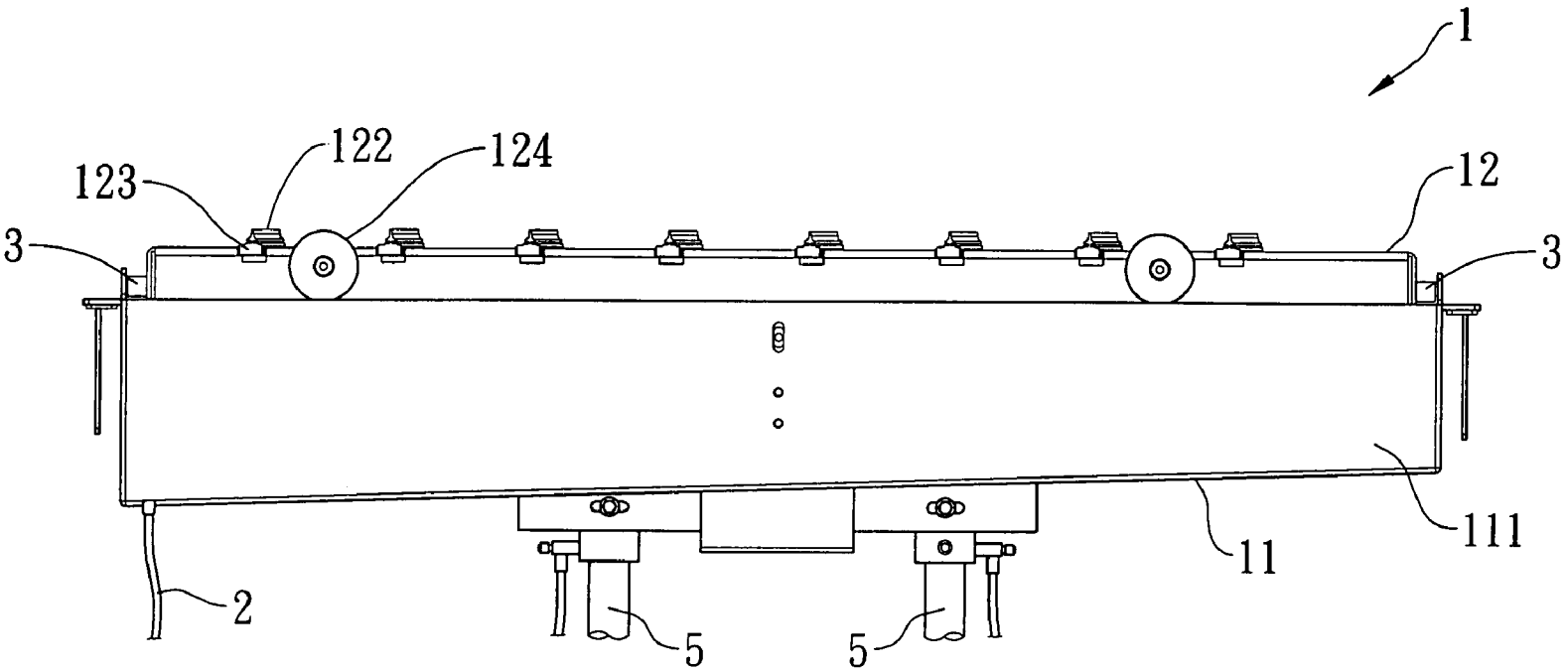
FIG. 2 is a sectional view of the printhead cleaning device for the large printer of the embodiment of the present invention.
Figure 3:
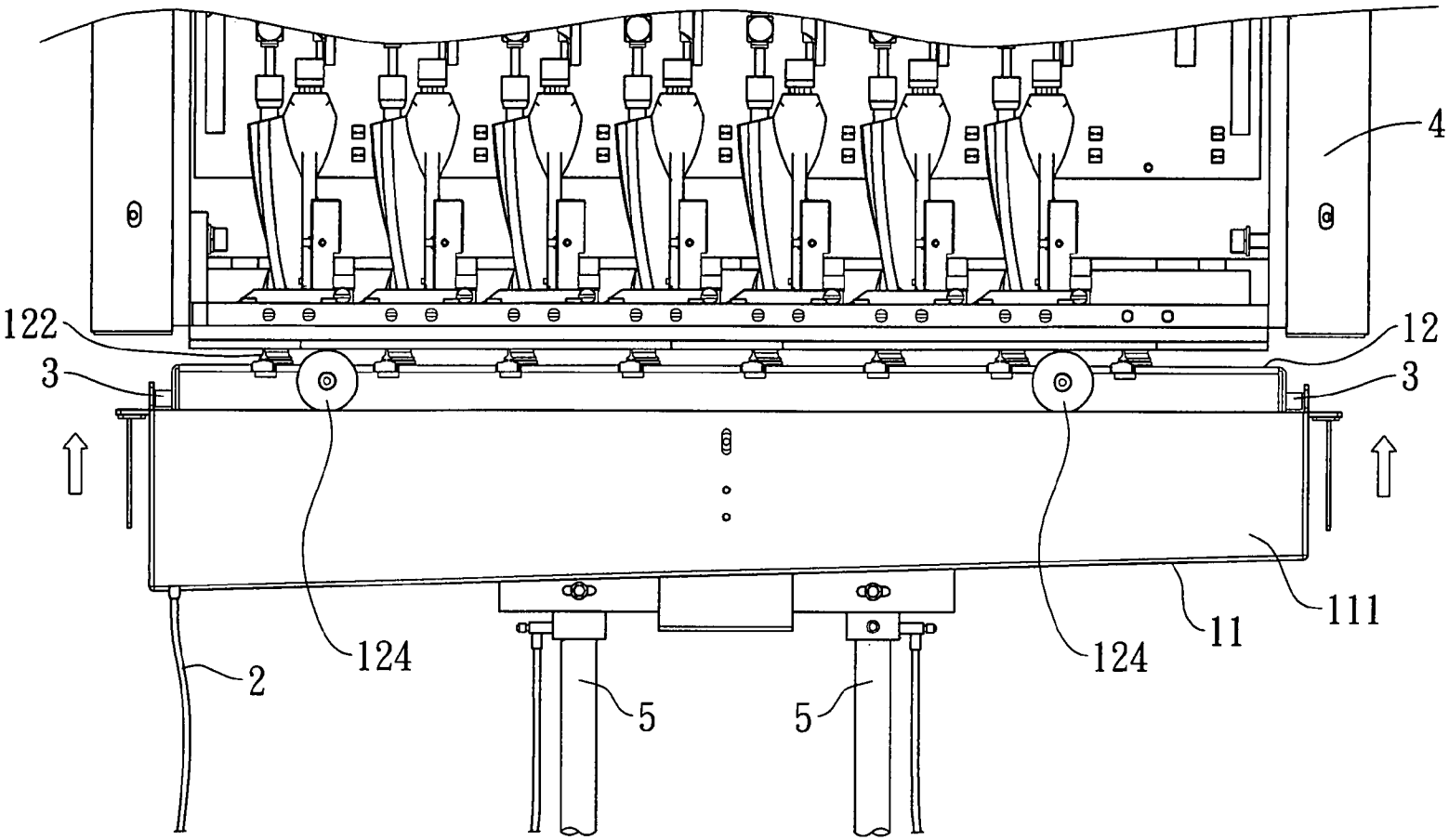
FIG. 3 is a schematic sectional view showing contact of the printhead cleaning device with a printhead set for the large printer of the embodiment of the present invention.

Referring firstly to FIGS. 1-3, they show a printhead cleaning device 1 for a large printer of an embodiment of the present invention. The printhead cleaning device 1 is provided at a lateral side of a printing rail of a printer and comprises a base 11 and a swinging platform 12.

The base 11 has four peripheral sides forming a receiving space 111 and is in the form of a trapezoid for the convenience of collecting waste ink. The bottom of the base 11 is connected with a waste ink pipe 2 through which the waste ink can be recovered.

The two lateral ends of the swinging platform 12 are movably and pivotally connected respectively to the base 11 by pivot axles 3, hence the swinging platform 12 can swing left and right on the base 11. The swinging platform 12 has thereon a plurality of elongate holes 121, so that the residual ink on an printhead set 4 can be collected in the receiving space 111 of the base 11 through the elongate holes 121. Every two elongate holes 121 have therebetween a scraper 122 which is in the shape of a taper sectionally and is made of soft material such as rubber, so that when the base 11 is pushed upwards by a pushing device 5 (as shown in FIG. 3), the scrapers 122 on the swinging platform 12 can have scraping actions against the moving printhead of the printhead set 4. The swinging platform 12 is provided with a plurality of engaging seats 123 respectively for movable connecting of the scrapers 122 thereon. Further the swinging platform 12 is provided on the lateral sides thereof with a plurality of spacer wheels 124 to render the swinging platform 12 to get its predetermined position more accurately when the base 11 is pushed upwards by the pushing device 5.

Referring to FIGS. 3-7, when in practicing, the two ends of the swinging platform 12 are pivotally connected with the base 11 by pivot axles 3. Thereby the swinging platform 12 can swing left and right on the base 11; when the printhead set 4 of the printer reaches an end of the printing rail for cleaning, the pushing device 5 (such as a gas pressure cylinder) provided in the printer can push the base 11 upwards to its predetermined position for cleaning with the help of the spacer wheels 124, and the swinging platform 12 swinging left and right can be adjusted suitably to make the scrapers 122 reach their best contact positions with the printhead in the printhead set 4 (as shown in FIG. 3).

Figure 4:
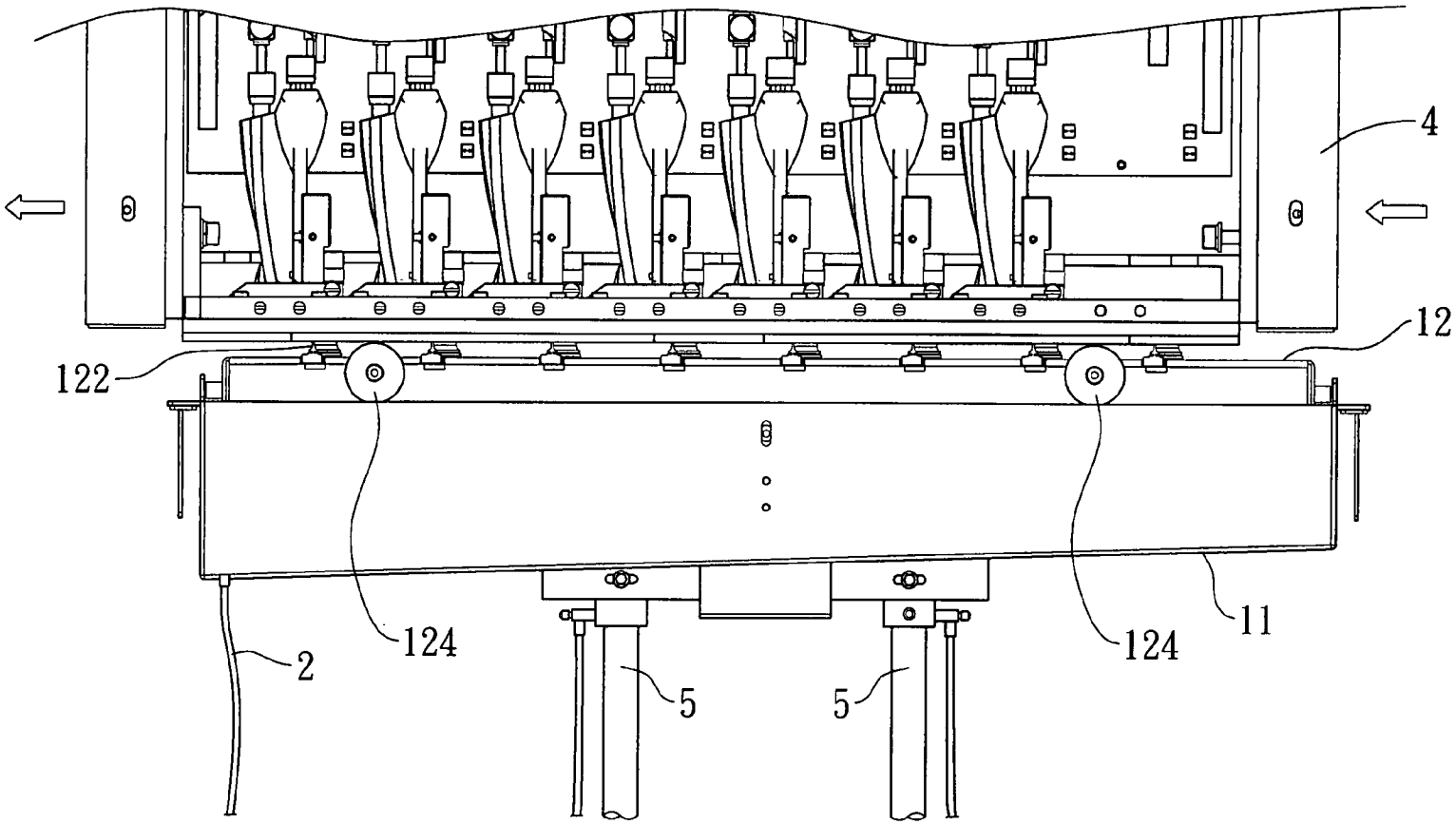
FIG. 4 is a schematic sectional view showing the state when the printhead set of the embodiment of the present invention moves leftwards to scrape ink.
Figure 5:
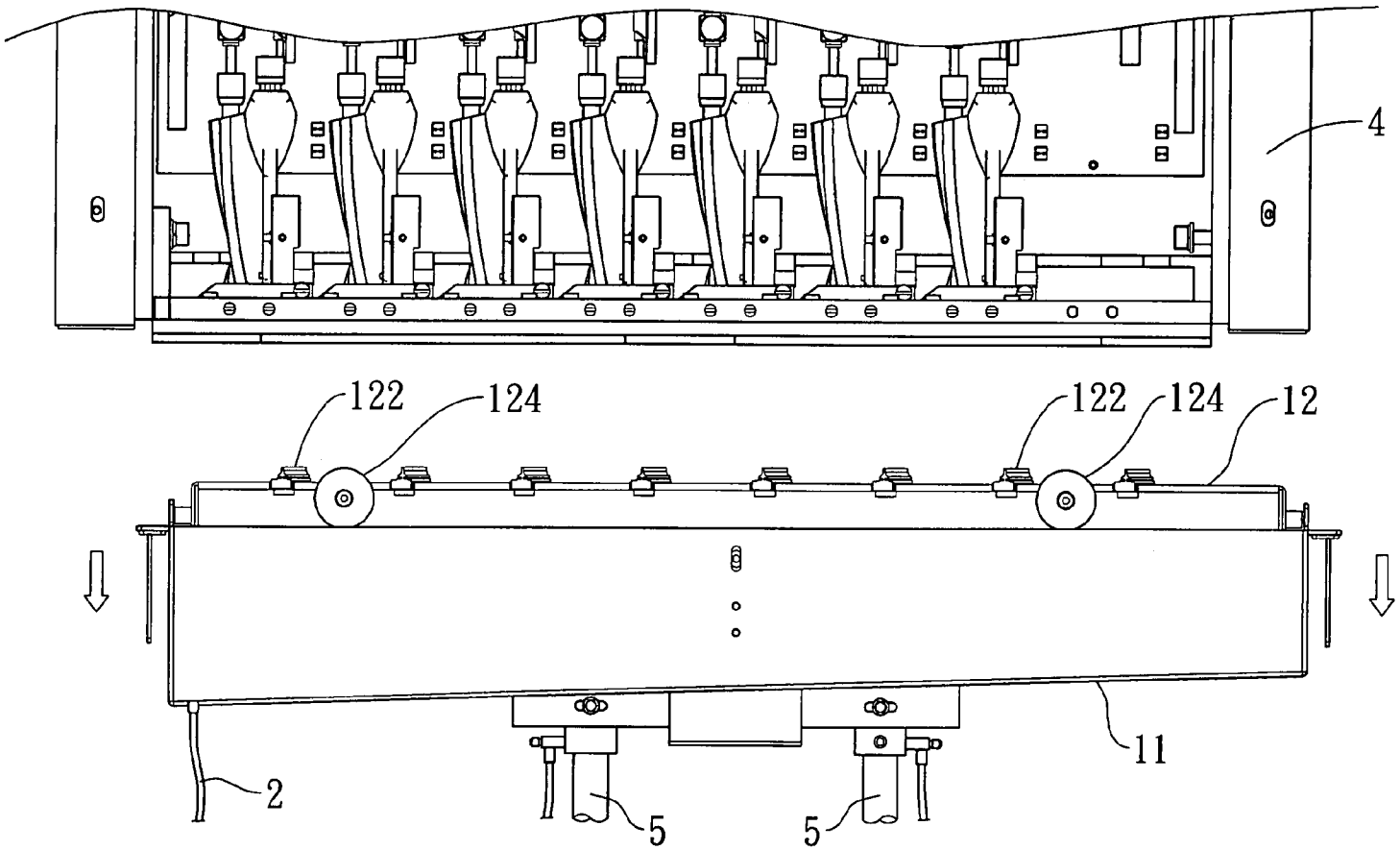
FIG. 5 is a schematic sectional view showing the state when the printhead cleaning device for the large printer of the embodiment of the present invention is lowered.
Figure 6:
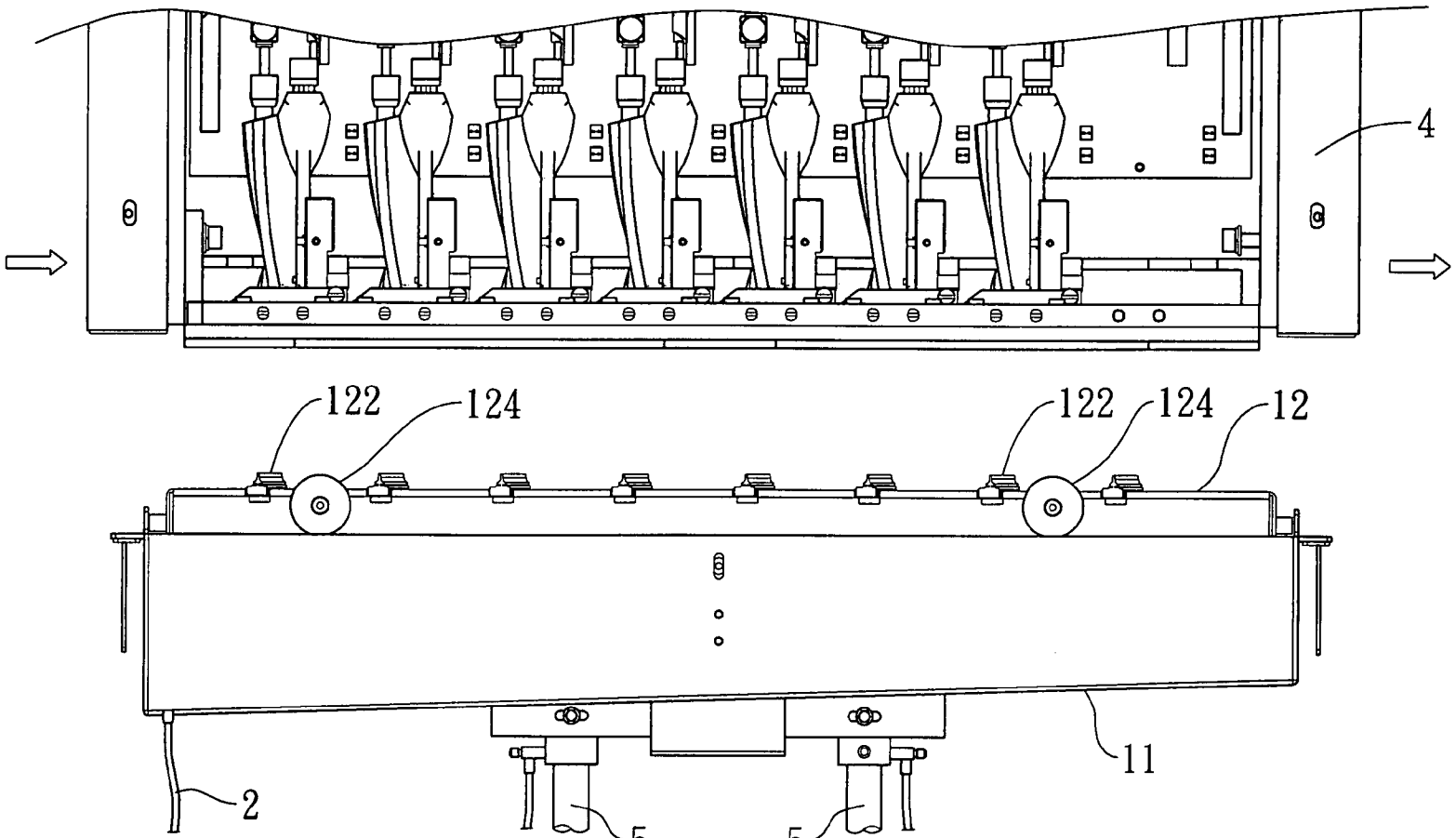
FIG. 6 is a schematic sectional view showing the state when the printhead set of the embodiment of the present invention moves rightwards.
Figure 7:
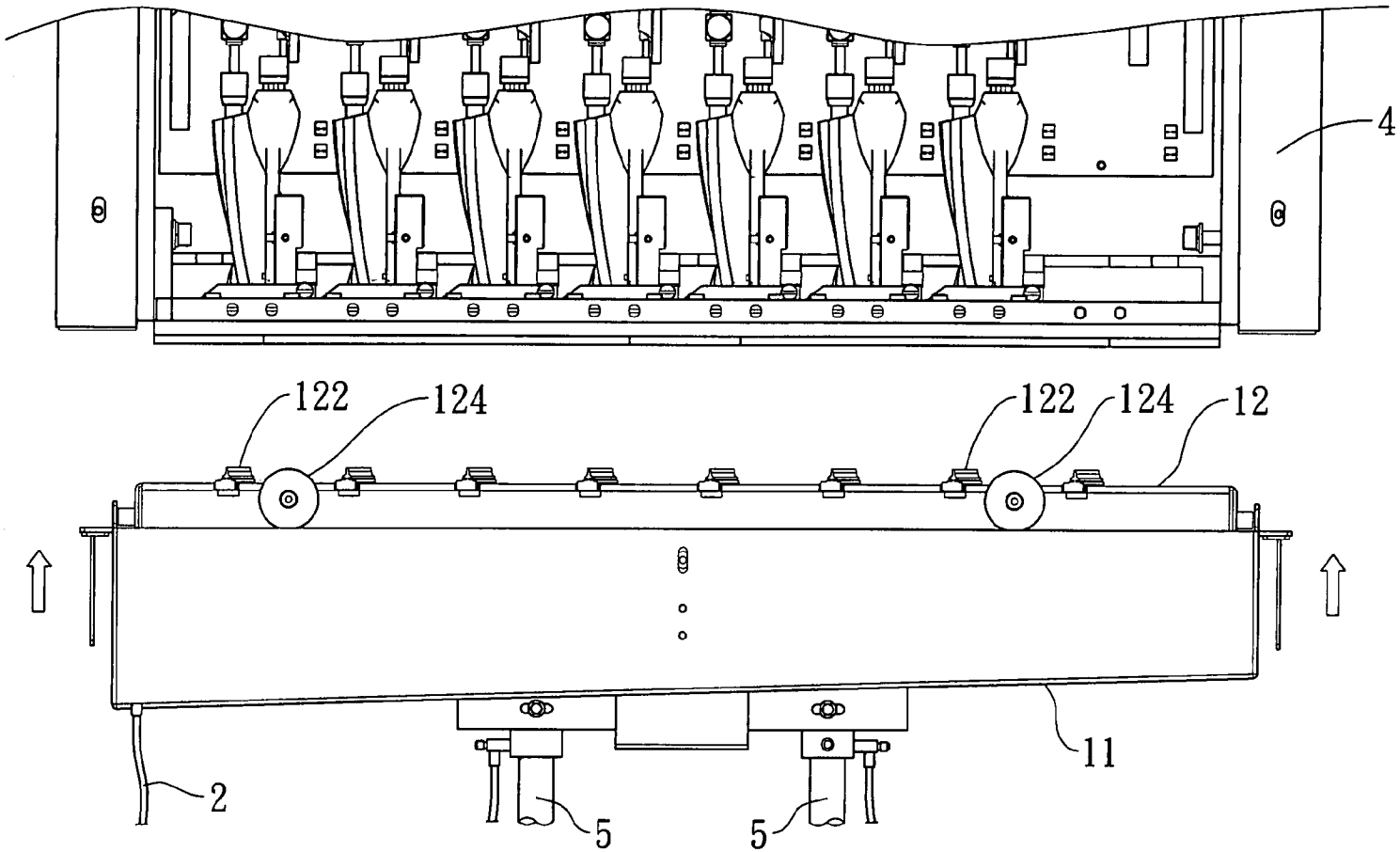
FIG. 7 is a schematic sectional view showing the state when the printhead cleaning device for the large printer of the embodiment of the present invention is raised.

As shown in FIG. 4, after positioning of the base 11, the printhead set 4 is moved towards one direction (for instance left), in order that the scrapers 122 each in the shape of a taper sectionally can exactly clean the printhead in the printhead set 4. And after cleaning, the base 11 is lowered by the action of the pushing device 5, and the printhead set 4 restores its original position (as shown in FIGS. 5-7). Then the steps stated above are repeated to raise the base 111 upwards to its predetermined position, and the printhead set 4 is moved leftwards again.

In this way, by repeated motion as stated above, the object of cleaning the printhead in the printhead set 4 is obtained, while the residual waste ink on the printhead set 4 and the waste ink scrapped off by the scrapers 122 can flow into the receiving space 111 of the base 11 through the elongate holes 121 provided on the swinging platform 12. All the waste ink is discharged to be dealt with via the waste ink pipe 2, and after use for a long time, damaged scrapers 122 can be drawn upwards out of the engaging seats 123 for changing.

Therefore, the present invention has the following advantages:

1. By providing the engaging seats on the swinging platform of the present invention, each engaging seat is provided for movably connecting a scraper thereon, so that after use for a long time, damaged scrapers can be drawn out of the engaging seats for convenient changing.
2. The scrapers of the present invention each is in the shape of a taper sectionally, and is made of soft material such as rubber. When cleaning the printhead set, the printhead is not subject to damage, and the design of the taper shape sectionally renders the waste ink to flow down along the shape to avoid returning of the waste ink to affect the next ink-jetting action.
3. The present invention is provided on the swinging platform with a plurality of spacer wheels. When the base is pushed upwards by the action of the pushing device, whatever a higher or a lower position that the printhead set is at, the spacer wheels can render the swinging platform to reach its cleaning position correctly. This can avoid collision of the printhead set against the printhead cleaning device, thus safety of the printhead set can be acquired.
4. The two lateral ends of the swinging platform of the present invention are movably and pivotally connected respectively to the base by pivot axles, hence the swinging platform can swing left and right on the base to contact the bottom of the printhead set. And so the scrapers can reach their best contact positions with the printhead.

In conclusion, according to the description disclosed above, the present invention surely can achieve the expected objects thereof to provide a printhead cleaning device for a large printer that can be securely aligned with the printhead set to achieve the effective cleaning purpose without damaging the latter. The device structure is simple for assembling, and is provided with drawable scrapers convenient for changing at any time. The embodiment stated above is only for illustrating the present invention, it will be apparent to those skilled in this art that various equivalent modifications or changes according to the idea of and without departing from the spirit of this invention shall also fall within the scope of the appended claims.

The invention claimed is:

1. A printhead cleaning device for a large printer provided on a lateral side of a printing rail of said printer, said device comprises:

a base, wherein said base has four peripheral sides forming a receiving space, and a swinging platform movably and pivotally connected to said base, said swinging platform has thereon a plurality of elongate holes, so that residual ink on a printhead set is collected in said receiving space of said base through said elongate holes, every two of said elongate holes have therebetween a scraper in the shape of a taper sectionally and made of soft material, so that when said base is pushed upwards by a pushing device to a predetermined position, said scrapers on said swinging platform have scraping actions against said printhead set in moving.

2. The printhead cleaning device for a large printer as claimed in claim 1, wherein: said swinging platform is provided on two lateral sides thereof with a plurality of spacer wheels to render said swinging platform to reach its predetermined position more accurately when said base is pushed upwards by said pushing device.

3. The printhead cleaning device for a large printer as claimed in claim 1, wherein: two ends of said swinging platform are pivotally and movably connected with said base by pivot axles.

4. The printhead cleaning device for a large printer as claimed in claim 1, wherein: a bottom of said base is connected with a waste ink pipe.

5. The printhead cleaning device for a large printer as claimed in claim 1, wherein: said scrapers are made of soft material such as rubber.

6. The printhead cleaning device for a large printer as claimed in claim 1, wherein: said swinging platform is provided with a plurality of engaging seats respectively for movable connecting of said scrapers thereon.

7. The printhead cleaning device for a large printer as claimed in claim 1, wherein: said base is in the form of a trapezoid for the convenience of collecting waste ink.

* * * * *